US005678765A

United States Patent [19]

Dobbs et al.

[11] Patent Number: 5,678,765

[45] Date of Patent: Oct. 21, 1997

[54] FOAM/SPRAY NOZZLE ASSEMBLY FOR TRIGGER SPRAYER

[75] Inventors: Douglas B. Dobbs, Yorba Linda; Adonis Spathias, Corona, both of Calif.

[73] Assignee: Calmar Inc., City of Industry, Calif.

[21] Appl. No.: 489,718

[22] Filed: Jun. 13, 1995

[51] Int. Cl.[6] ..... B05B 9/043

[52] U.S. Cl. ..... 239/333; 239/343; 239/428.5; 239/512; 239/DIG. 23

[58] Field of Search ..... 239/333, 343, 239/428.5, 462, 504, 512, 541, DIG. 23; 210/499

[56] References Cited

U.S. PATENT DOCUMENTS

| | | | |
|---|---|---|---|
| 3,941,703 | 3/1976 | Binard | 210/499 |
| 4,350,298 | 9/1982 | Tada | 239/343 X |
| 4,779,803 | 10/1988 | Corsette . | |
| 4,925,106 | 5/1990 | Mass et al. | 239/504 X |
| 5,366,160 | 11/1994 | Balderrama | 239/343 X |
| 5,397,060 | 3/1995 | Maas et al. . | |
| 5,476,588 | 12/1995 | Nagaoka | 210/499 |

FOREIGN PATENT DOCUMENTS

| | | | |
|---|---|---|---|
| 268733 | 12/1965 | Australia | 239/343 |
| 60-27481 | 8/1985 | Japan . | |

*Primary Examiner*—Andres Kashnikow
*Assistant Examiner*—Steven J. Ganey
*Attorney, Agent, or Firm*—Watson Cole Stevens Davis, P.L.L.C.

[57] ABSTRACT

A manually actuated liquid sprayer has a ported element selectively movable between a retracted position and an extended position at which the element lies in the path of the spray plume for mitigating the spray. The element has a cylinder with a smooth inner wall defining a turbulence chamber coaxial with the discharge orifice of the nozzle cap to which the element is mounted. A transversely extending perforate wall is located in the cylinder, and has an open port of a size greater than that of the discharge orifice and being coaxial therewith. The element is movable relative to the nozzle cap between the retracted position at which the liquid spray passes through the open port without influence from any portion thereof, and the extended position at which the liquid spray impacts against the smooth inner wall to mix with air in the chamber and passes through the perforate wall to create foam ejected from the element.

7 Claims, 2 Drawing Sheets

FOAM/SPRAY NOZZLE ASSEMBLY FOR TRIGGER SPRAYER

RELATED APPLICATION

This application relates to application Ser. No. 08/392,397, filed Feb. 22, 1995, as a continuation-in-part of Ser. No. 08/352,805, filed Dec. 1, 1994, and now abandoned.

BACKGROUND OF THE INVENTION

This invention relates generally to a trigger actuated pump sprayer having a nozzle assembly which includes an element selectively movable between retracted and extended positions relative to the nozzle between spray and foaming positions. The shiftable element has a turbulence chamber for creating foam in the extended position in combination with a molded plastic grating to enhance foaming.

U.S. Pat. No. 4,779,803 discloses a manually actuated liquid sprayer having an element mounted on its nozzle for selective movement between retracted and extended positions relative to the front wall of the nozzle. The element has an open port coaxial with the discharge orifice of a size greater than that of the orifice, the element comprising a mitigating element for mitigating the divergent spray issuing from the orifice. The open port is sized relative to that of the spray plume such that the mitigating element has no effect on the liquid spray as it passes through the open port. The element includes a ported mesh screen through which the spray emerges for creating foam in the extended position of the element.

U.S. Pat. No. 5,397,060 discloses a foam-spray-off trigger sprayer having an axially moveable perforated wall mounted for axial movement inside a front barrel of a trigger sprayer nozzle, whereby the moveable perforated wall can be moved between (a) a stream position, where a central opening in the perforated wall is positioned closely adjacent an outlet orifice in a back wall of a foam generating chamber defined within the front barrel to (b) a foam generating position where the perforated wall is positioned forwardly of the outward orifice where droplets of liquid impinge upon the perforated wall, are deflected and mix with air to form foam.

According to the prior art, foaming is effected in the extended position as the divergent spray passes through a perforated plate or wall for producing a foam. An unacceptable amount of airborne droplets is introduced into the atmosphere with such foamers, giving rise to vapors produced which may cause burning of the eyes, nose and mouth especially when discharging household cleaners. Also, the foam is of diminished quality which dribbles when applied to the target.

SUMMARY OF THE INVENTION

It is the objective of the present invention to provide a foam/spray nozzle assembly for a manually actuated liquid sprayer in which a foaming element is selectively moveable between out of service and in service positions for spraying and foaming, the element having a combined turbulence chamber upstream of a perforate wall to effect foaming in the extended position with a significant reduction in the amount of airborne droplets into the atmosphere while at the same time creating an acceptable quality foam which does not dribble when applied to the target and which hangs to the target through an acceptable interval.

According to the invention, the ported shiftable element has a cylinder with a smooth inner wall defining a turbulence chamber coaxial with the discharge orifice, and a transversely extending perforate wall mounted in the cylinder. The wall has an open port of a size greater than that of the discharge orifice, and is coaxial therewith. The element is mounted on the nozzle for axial movement relative thereto between the retracted and extended positions. In the retracted position, the element has no effect on the liquid spray as it passes through the open port. In the extended position, the liquid spray impacts against the smooth inner wall of the turbulence cylinder to mix with air in the chamber to create and concentrate foam, and passes through the perforate wall to enhance the formation of foam ejected from the element.

The perforate wall may comprise sets of spaced ribs lying in spaced parallel planes with the ribs contiguous and extending in perpendicular directions. The ribs may be rectangular in cross-section with the long sides thereof extending in the axial direction.

The perforate wall may otherwise be in the form of spaced ribs in parallel sets with the ribs extending in a common direction, the ribs of one set being spaced a distance substantially equal to one-half the spacing of the ribs of the other set. The ribs may be trapezoidal in section with the ribs of a downstream set converging forwardly and the ribs of the upstream set diverging forwardly.

Other perforate wall structures comprised of ribs in accordance with the aforementioned application can be adapted for the present invention.

DETAILED DESCRIPTION OF THE INVENTION

Figure 1:
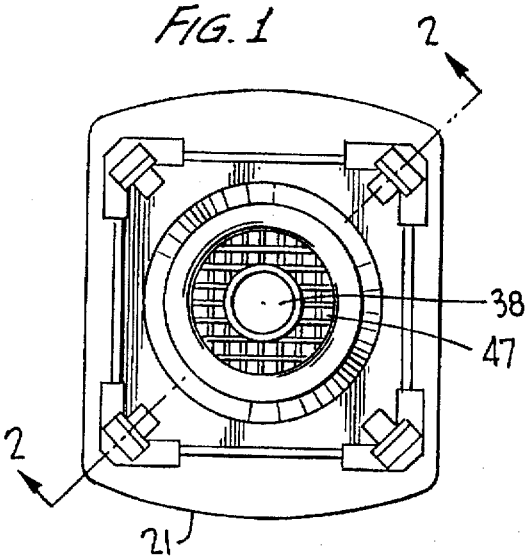
FIG. 1 is a front plan view of one embodiment of the shiftable element of the nozzle assembly according to the invention.
Figure 2:
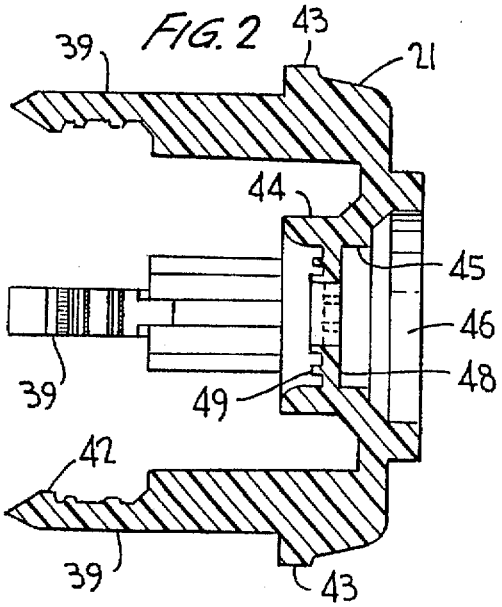
FIG. 2 is a sectional view taken substantially along the line 2—2 of FIG. 1.
Figure 3:
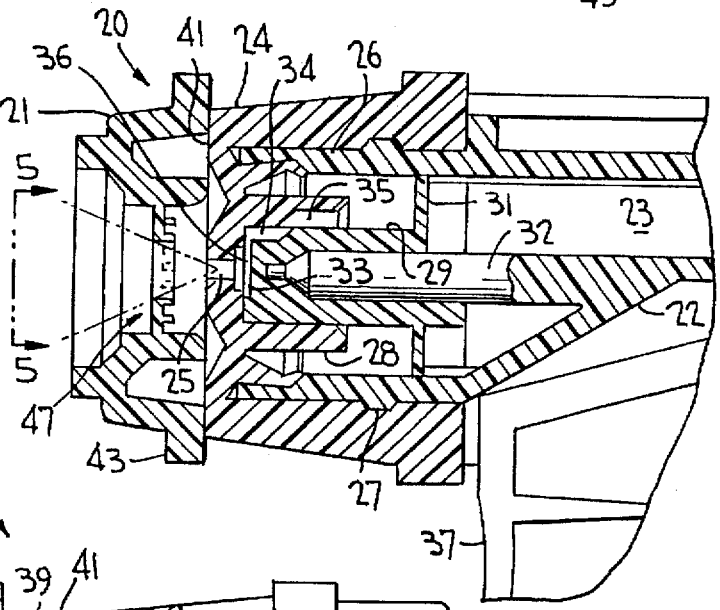
FIG. 3 is a vertical sectional view of the FIG. 1 element mounted to the nozzle of a trigger sprayer, in the retracted position.
Figure 4:
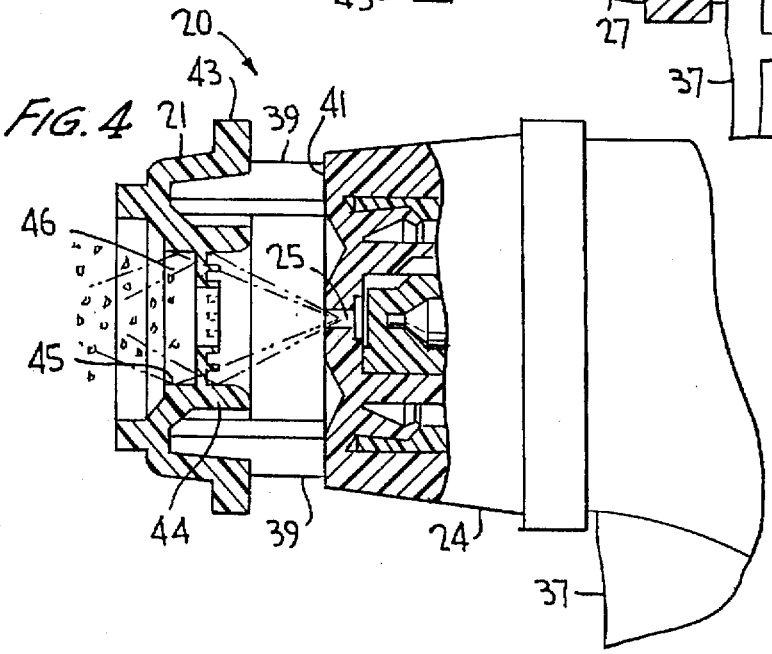
FIG. 4 is a view similar to FIG. 3 of the shiftable element shown in its extended position.
Figure 5:
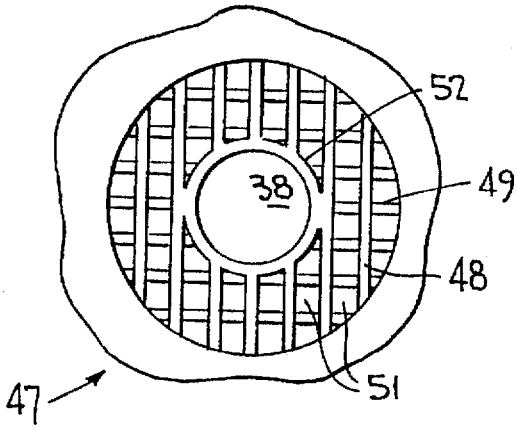
FIG. 5 is an enlarged front view of the FIG. 1 perforate wall of the shiftable element.

Turning now to the drawings wherein like reference characters refer to like and corresponding parts throughout the several views, a trigger actuated pump sprayer generally designated 20 is shown in FIGS. 3 and 4 having a ported movable element 21 generally shown mounted thereon.

The pump sprayer is of known construction, such as that disclosed in the aforementioned related application, in which its pump body 22 defines a discharge passage 23. A rotatable nozzle cap 24 having a central discharge orifice 25 is snap-fitted about discharge end 26 of the pump body as at 27. The cap has an internal sleeve 28 in engagement with a probe cap 29 carrying an annular discharge flap valve 31.

The probe cap is fixed to the end of a probe 32, and has a swirl chamber 33 formed at its outer end. Longitudinal grooves 34 and 35 on the probe cap and sleeve 28 are aligned upon relative rotation of the nozzle cap for admitting liquid product via the discharge valve through tangential channels 36 into the swirl chamber upon pumping action of the sprayer for inducing a swirl through the liquid product to issue through the discharge orifice as a divergent spray. Pumping action is effected upon manual actuation of trigger lever 37 hinged to the pump body in a known manner.

The pump sprayer may have any other type swirl or spin chamber to internally effect a vortex of the liquid product, causing the product to discharge from orifice 25 as a spray plume typically in the form of a diverging spray cone. And, the spray mechanics may be provided as in accordance with U.S. Pat. No. 4,706,888 for producing a spray discharge and for closing the discharge upon rotation of the nozzle cap between spray-off and stream-off positions.

Element 21 of the invention is similar to that disclosed in the aforementioned related application except that the element has an open port 38 therein coaxial with the discharge orifice, and may be telescopically mounted on the nozzle cap for movement between the retracted position of FIG. 3 and the extended position of FIG. 4. A plurality of support legs 39 on element 21 project into a like plurality of elongated axial openings (not shown) located in the nozzle cap and opening into its outer wall 41. Projections 42 formed on the legs may be engageable with stops provided in the nozzle cap grooves for limiting the outward extent of element 21 to its FIG. 4 position, similarly as structured in U.S. Pat. No. 4,779,803.

Element 21 may extend outwardly as at 43 from one or more side walls of the nozzle cap so as to provide gripping means for facilitating manual sliding movement of the element.

Element 21, in its FIG. 4 extended position, functions as a foamer cap as in the manner disclosed in the aforementioned related application. The spaces between legs 39 form air aspiration openings, and the element has an inner cylinder 44 coaxial with port 38 and discharge orifice 25. The cylinder has a smooth inner wall 45, the cylinder defining a turbulence chamber 46, such that during pumping, the divergent spray impacts against inner wall 45 of the turbulence chamber, thereby creating and concentrating a foam as the spray particles mix with air in the turbulence chamber as aspirated through the openings formed between spaced legs 39.

In accordance with one embodiment of the invention, a foam enhancer or spray particle mitigator is provided in the form of a screen or grate 47 shown in FIGS. 1 to 6 which include first and second sets of ribs 48 and 49 respectively lying in parallel planes and formed integrally at opposite ends with inner wall 45 of cylinder 44.

Ribs 48 and 49 are contiguous, the ribs of each set being respectively parallel and extending in mutually perpendicular directions forming substantially rectangular openings 51 between the ribs of the two sets. And, similarly as in the aforementioned related application, ribs 48 and 49 may each be rectangular in cross-section with the longer sides thereof extending along the downstream direction of flow of the liquid product through the discharge orifice.

The disposition of the longer sides of the ribs along the flowpath tends to enhance the foaming formation as the foam bubbles concentrated in turbulence chamber 46 first impact the confronting flat surfaces of ribs 49, glide along the opposing sides of ribs 49 which accelerate the turbulent flow as the foam bubbles then impact against the confronting flat surfaces of ribs 48 and glide along the opposing sides thereof which further accelerate the turbulent flow. The foam further admixes with the air in chamber 46 to enhance the generation of foam which passes through screen 48 to the target.

Figure 6:
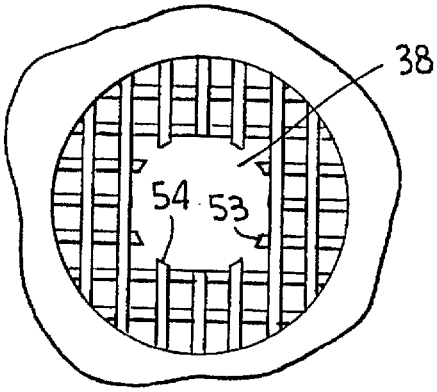
FIGS. 6 and 7 are views similar to FIG. 5 of other embodiments of the perforate wall.

In a retracted position of element 21 shown in FIG. 3, the element bears against front wall 41 of the nozzle cap, and port 38 is sized relative to the divergent spray plume generated as to permit the spray to pass through open port 38 without influence from any portion thereof, Port 38 may be defined by a ring 52 molded integrally with the inner terminal ends of ribs 48 and 49. However, ring 52 has no function other than to simply interconnect the inner terminal ends of ribs 48 and 49, since ring 52 may be entirely eliminated as shown in FIG. 6, whereupon inner terminal ends 53 and 54 of the ribs themselves define open port 38.

Figure 7:
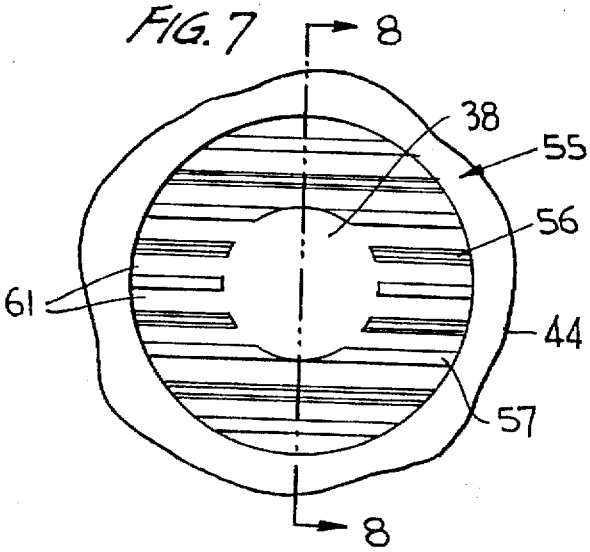
Figure 8:
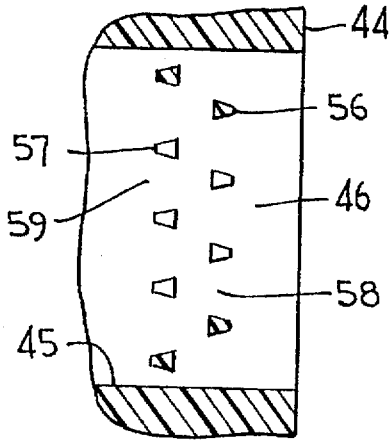
FIG. 8 is a view taken substantially along the line 8—8 of FIG. 7.

The foam enhancer of the invention in combination with cylinder 41 of element 21 may be in the form of a grate or grid 55 shown in FIGS. 7, 8 integrally molded in cylinder 44 at an axial location similar to that of screen 47, such that in the FIG. 4 extended position of element 21, the divergent spray impacts against inner wall 45 to create and concentrate foam prior to passing through the openings between the screen or grate ribs to enhance the foaming formation. The foam bubbles which may be intermixed with spray particles likewise impact against smooth inner wall 45 located downstream of screen 47 or grid 55, as shown, to further enhance the foaming formation. Of course, the screen or grate can be located closer to the downstream end of inner wall 45 such that substantially all the foam bubbles and/or spray particles emerge directly from the downstream side of the screen or grate as a foam without further impacting against wall 45 downstream of the screen or grid.

Grate 55 comprises a plurality of ribs 56, 57, each extending in a common direction, such as horizontal. Ribs 56 are parallel to one another and are mutually spaced apart to define uniform openings 58 of a first set of ribs. Similarly, ribs 57 are parallel to one another and are mutually spaced apart to define uniform openings 59 of a second set. The first and second sets of ribs are relatively offset, such as in a vertical direction as shown, a distance substantially equal to one-half spacing 58 or 59, such that the net spacing of ribs between the two sets defines openings 61 shown in FIG. 7.

With this arrangement, grater larger spacings 58 and 59 of the ribs in the respective sets simplify the tooling and molding operations and yield an effective spacing 61 which is substantially one-half either spacing 58 or 59.

The two sets of ribs lie in spaced apart parallel planes, the upstream surfaces of the ribs of both sets being flat similar to that of the ribs of screen 47. Ribs 56, 57 may be trapezoidal in section, with the opposing sidewalls of the ribs of the first set converging in the downstream direction, and the opposing sidewalls of the ribs of the second set diverging in the downstream direction. Of course, ribs 56, 57 of both sets can be so oriented that their opposing sidewalls either converge in the downstream direction or both diverge in the downstream direction.

The flat surfaces of the ribs confronting the turbulence chamber provide impact surfaces for the foam bubbles created in the chamber, enhance the foaming formation, and facilitate virtually unimpeded discharge of foam through the grid outwardly of the end of element 21.

The inner terminal ends of ribs 56 and 57 may together form open port 38 or may be interconnected by a ring such as 52, not shown, to form the open port.

Figure 9:
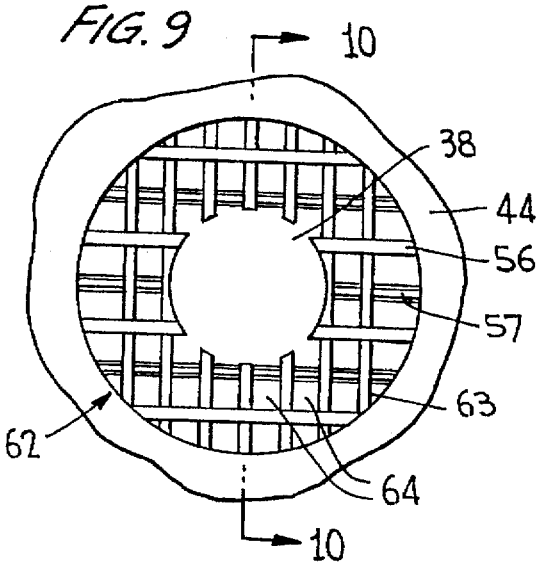
FIG. 9 is a front view of another embodiment of the perforate wall of the shiftable element.
Figure 10:
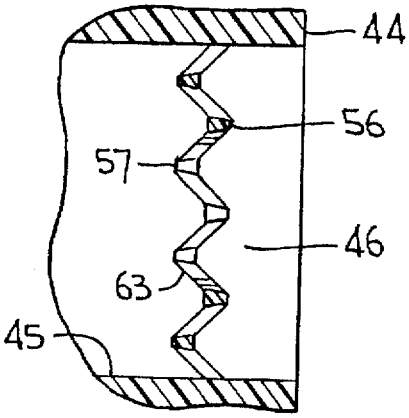
FIG. 10 is a view taken substantially along the line 10—10 of FIG. 9.

Another embodiment of the foam enhancer as part of element 21 employed in combination with turbulence cylinder 46 is shown in FIGS. 9, 10 in the form of a screen 62 similar to that of grate 55 in that it includes first and second sets of relatively offset ribs 56, 57 lying in spaced planes with the ribs being spaced apart as at 58 and 59. In addition, a third set of mutually spaced apart ribs 63 extend in a direction perpendicular to the common direction along which ribs 56, 57 extend. Ribs 63 are zig-zag shaped and are molded to intersect with horizontal ribs 57 while extending behind or downstream of ribs 56 as shown in FIG. 10. The mutually spaced ribs of the three sets define openings 64, shown in FIG. 9. The back faces of ribs 63 are flat and may be trapezoidal in section with opposing side walls thereof either converging or diverging in the downstream direction.

Many modifications and variations of the present invention are made possible in the light of the above teachings. It is therefore to be understood that within the scope of the appending claims, the invention may be practiced otherwise than as specifically described.

What is claimed is:

1. A manually actuated liquid sprayer comprising a nozzle containing a discharge orifice for discharge under pressure of a divergent plume of liquid spray in a downstream direction, and a ported element selectively movable between a retracted position and an extended position at which the element lies in the path of the spray plume for mitigating the spray, the element having a cylinder with a smooth inner wall defining a turbulence chamber coaxial with the discharge orifice, a transversely extending perforate wall located in said cylinder, said perforate wall having an open port of a size greater than that of the discharge orifice and being coaxial therewith, and said perforate wall comprising first and second sets of ribs respectively lying in first and second parallel planes, said ribs of said first set being contiguous to said ribs of said second set, said ribs being mutually spaced apart in each said set to define uniformly sized openings therebetween, said ribs of both said sets having flat surfaces facing upstream and lying perpendicular to a central axis of said cylinder for generating foam as the foam impacts against said flat surfaces, the element being mounted on the nozzle for axial movement relative thereto between said retracted position at which the liquid spray passes through the open port without influence from any portion thereof, and said extended position at which the liquid spray impacts against said smooth inner wall to mix with air in the chamber to create foam while passing through said perforate wall which enhances the creation of foam ejected from a downstream end of said cylinder.

2. The liquid sprayer according to claim 1, wherein the element is mounted for telescoping sliding movement relative to the nozzle.

3. The liquid sprayer according to claim 1, wherein said ribs of said first and second sets are rectangular in cross-section, the longer sides of said ribs extending in said downstream direction.

4. A manually actuated liquid sprayer comprising a nozzle containing a discharge orifice for discharge under pressure of a divergent plume of liquid spray in a downstream direction, and a ported element selectively movable between a retracted position and an extended position at which the element lies in the path of the spray plume for mitigating the spray, the element having a cylinder with a smooth inner wall defining a turbulence chamber coaxial with the discharge orifice, a transversely extending perforate wall located in said cylinder, said perforate wall having an open port of a size greater than that of the discharge orifice and being coaxial therewith, and said perforate wall comprising first and second sets of spaced apart ribs respectively lying in first and second parallel planes and extending a common direction, said ribs of said second set being equally spaced apart and offset relative to said ribs of said second set a distance substantially equal to one-half the spacing of said ribs of said first set, the element being mounted on the nozzle for axial movement relative thereto between said retracted position at which the liquid spray passes through the open port without influence from any portion thereof, and said extended position at which the liquid spray impacts against said smooth inner wall to mix with air in the chamber to create foam while passing through said perforate wall which enhances the creation of foam ejected from a downstream end of said cylinder.

5. The liquid sprayer according to claim 4, wherein said element further comprises a third set of spaced ribs interconnecting with and extending in a direction perpendicular to said ribs of said first and second sets.

6. The liquid sprayer according to claim 5, wherein said first set is located downstream of said second set, opposing sidewalls of said ribs of said first set converging in said downstream direction, and opposing sidewalls of said ribs of said second set diverging in said downstream direction.

7. The liquid sprayer according to claim 4, wherein said first set is located downstream of said second set, opposing sidewalls of said ribs of said first set converging in said downstream direction, and opposing sidewalls of said ribs of said second set diverging in said downstream direction.

* * * * *